US005613184A

United States Patent [19]

Purnell et al.

[11] Patent Number: 5,613,184

[45] Date of Patent: Mar. 18, 1997

[54] ALUMINIUM ALLOYS

[75] Inventors: Charles G. Purnell, W. Midlands; Paul Smith, Birmingham; Mohammad S. Mahmoud, London, all of Great Britain

[73] Assignees: The Aluminium Powder Company Limited, Sutton Coldfield; Brico Engineering Limited, Coventry, both of England

[21] Appl. No.: 553,712

[22] PCT Filed: May 31, 1994

[86] PCT No.: PCT/GB94/01180

§ 371 Date: Nov. 30, 1995

§ 102(e) Date: Nov. 30, 1995

[87] PCT Pub. No.: WO94/29489

PCT Pub. Date: Dec. 22, 1994

[51] Int. Cl.[6] ..... B22F 3/16; C22C 1/04; C22C 21/02; C22C 21/04

[52] U.S. Cl. ..... 419/38; 419/46; 75/249

[58] Field of Search ..... 419/38, 46; 75/249

[56] References Cited

U.S. PATENT DOCUMENTS 4,177,069 12/1979 Kobayashi et al. .
5,366,691 11/1994 Takeda et al. ..... 420/548
5,494,540 2/1996 Ochi et al. ..... 148/552
5,523,050 6/1996 Lloyd et al. ..... 420/528

FOREIGN PATENT DOCUMENTS

436952A1 7/1991 European Pat. Off. ..... C22C 1/04
466120A1 1/1992 European Pat. Off. ..... C22C 1/04
61-238947 10/1986 Japan ..... C22F 1/043

OTHER PUBLICATIONS

Patent Abstracts of Japan, vol. 6, No. 120 (M–140) 3 Jul. 1982 & JP 57047801, 18 Mar. 1982 (see abstract).
Patent Abstracts of Japan, vol. 14, No. 335 (M–1000) 19 Jul. 1990 & JP 2115303, 27 Apr. 1990 (see abstract).
Derwent Publications Ltd. (Database WPI, Week 7846) JP 53118209, 16 Oct. 1978 (see abstract).

*Primary Examiner*—Charles T. Jordan
*Assistant Examiner*—Daniel Jenkins
*Attorney, Agent, or Firm*—Synnestvedt & Lechner

[57] ABSTRACT

An aluminium alloy made by a powder metallurgy route and a method for its production are described. The method comprises the steps of producing a first powder of a near-eutectic aluminium-silicon based alloy; producing a second powder of a hypereutectic aluminium-silicon based alloy; mixing desired proportions of the two powders together; compacting the powder mixture and sintering the compacted powder.

15 Claims, 4 Drawing Sheets

ALUMINIUM ALLOYS

The present invention relates to aluminium alloys and to a method for their production by a powder metallurgy route.

With the ever increasing emphasis on improved fuel economy and reduced emission levels for internal combustion engines in vehicles, there is a consequent trend towards making vehicles and the components which go into them lighter in weight. Examples of this trend include the increasing use of aluminium cylinder heads in engines and various components in aluminium alloy which at one rime were made in cast iron, for example.

In general, aluminium alloys are considered to be good candidates for replacing some automotive components due to their relatively high strength to weight ratio. Additionally, their good corrosion resistance and high thermal conductivity make such alloys attractive for some applications within a vehicle.

Increasingly, silicon-containing aluminium alloys are now being considered for wear-resistant applications in the engine in addition to structural applications on the vehicle. Examples of such applications where wear-resistance is needed are in camshaft pulleys, rotors for air-conditioning units, pistons and tappets. Generally, aluminium alloys in vehicle applications have been produced by casting and machining or forging and machining. It is highly desirable to be able to produce a component to near net-shape and to minimise the amount of subsequent machining required.

Aluminium silicon alloy materials made by a powder metallurgy route have generally been fully or nearly fully densified by subsequent forging or extrusion operations or the like to give a strong, relatively uniform structured material from which a part is then machined. Sintering of fully pre-alloyed aluminium/silicon powders without additional sintering aids, has been seen as a difficult and unreliable process, particularly for hypereutectic aluminium/silicon compositions. The tenacious oxide film on aluminium powder particles inhibits bonding of the powder particles during sintering.

It is an object of the present invention to produce an aluminium silicon alloy having an overall hypereutectic composition and provide a method for its production which will allow alloys suitable for some wear-resistant and structural applications to be produced by a near net-shape compaction-and sinter powder metallurgy route. It is a consequence of the present invention that, because of the high silicon content, the compaction process is eased compared with conventional aluminium powder metallurgy materials, and galling (sticking) of the compaction die is much reduced. According to one aspect of the present invention there is provided a method for the production of an aluminium alloy by a powder metallurgy route, the method comprising the steps of producing at least a first powder of a near-eutectic aluminium-silicon based alloy; producing at least a second powder of a hypereutectic aluminium-silicon based alloy; mixing desired proportions of the at least first and second powders together; compacting the powder mixture and sintering the compacted powder.

Hereinafter, the term "near-eutectic" aluminium-silicon based alloy refers to an aluminium alloy containing from 9 to 13 wt % of silicon. The position of the eutectic point is influenced by additional alloying elements and by the solidification parameters experienced by the powder during manufacture. Similarly, for the purposes of this specification, a hypereutectic aluminium-silicon based alloy is defined as comprising more than 13 wt % of silicon.

One or both of the constituent first and second aluminium alloy powders may contain further alloying additions which confer improved properties by, for example, solution hardening and/or precipitation hardening.

One or both constituent first and second aluminium alloy powders may have compositions which, at the interparticulate interfaces generate a transient liquid phase to further assist the sintering operation.

The alloy powders may be made by one or more of the currently known powder production methods.

The powder mixture may also include additions such as a fugitive lubricant wax to aid pressing for example.

The powder mixture may also include additions to act as sintering aids. Examples of such additions may include copper, magnesium or silicon low-melting point eutectic forming materials.

Sintering temperatures may generally lie in the range from about 520° C. to about 600° C., with a preferred range lying from about 540° C. to about 580° C., with sintering times from about 5 to about 60 minutes.

As an example of one embodiment of the present invention, we have found that a near-eutectic alloy having a nominal composition of 11 Si/l Cu/Bal Al (referred to as alloy "A" hereinafter) produces useful materials when mixed and processed with a hypereutectic alloy known under the general designation of alloy "B" hereinafter and having a nominal composition of 18 Si/4.5 Cu/0.5 Mg/1.1max Fe/ Bal Al. The relative proportions may lie in the range from about 25% A: 75% B to about 75% A: 25% B. Preferably, the relative proportions may lie in the range from about 40% A: 60% B to 60% A: 40% B. More preferably still, the relative proportion may be approximately equal to one another, ie about 50% A: about 50% B to produce materials having a desirable balance of properties.

We have found that some critical mechanical properties of alloys comprising about equal proportions of the two constituent alloy powders are far superior to the properties of either of the individual first or second constituent alloy powders when processed alone under the same conditions or of a single prealloyed powder having the final overall composition of the mixed powders, or under conditions which would be expected to produce better properties in the individual constituent alloys. It is not known exactly why this unexpected synergistic effect occurs, but there is evidence of good sinterability in the mixtures.

According to another aspect of the present invention there is provided an aluminium alloy made by a powder metallurgy route having a structure comprising at least two interpenetrating reticular structures derived from the original powder particles, said at least two structures including a first structure comprising a near-eutectic aluminium-silicon based material and a second structure comprising a hypereutectic aluminium-silicon based material.

The two extended three-dimensional reticular structures may have an intermediate zone formed by interfacial diffusion or by a reaction between the at least two types of prior particles during the sintering operation. The extent of the intermediate zone may vary according to the relative proportions of the at least two constituent reticules and with the degree of inter-diffusion which has occurred during the sintering operation.

The constituent at least first and second aluminium alloy powders which form the at least two reticular structures may include one or more alloys which undergoes an age or precipitation hardening reaction in response to suitable heat treatment. Aluminium-silicon based alloys giving such a reaction may include one or more of copper, magnesium, nickel, chromium, iron, manganese and other transition and rare earth metals in their composition.

In order that the present invention may be more fully understood, examples will now be described by way of illustration only with reference to the accompanying drawings, of which:

SUMMARY OF THE INVENTION

Test samples were made from two batches of powder designated "A" and "B" having the compositions shown below in Table 1.

TABLE 1

| Element | Alloy | |
|---|---|---|
| Actual wt % | A | B |
| Si | 10.23 | 17.70 |
| Cu | 1.04 | 4.20 |
| Mg | 0.05 | 0.55 |
| Fe | 0.16 | 0.35 |
| Cr | 0.001 | 0.008 |
| Ni | 0.004 | 0.02 |
| Mn | 0.04 | 0.23 |
| Zn | 0.04 | 0.07 |
| Ti | 0.05 | 0.04 |

The powders were made by air atomization of melts which produced a relatively coarse powder having irregular shaped particles. The particle size distribution is given below in Table 2.

TABLE 2

| Sieve Aperture (μm) | A | B |
|---|---|---|
| +150 | 19.3 | 21.8 |
| +106 | 11.8 | 11.5 |
| +75 | 14.6 | 13.2 |
| +63 | 7.0 | 6.5 |
| +53 | 7.6 | 6.1 |
| +45 | 4.5 | 5.1 |
| −45 | 35.2 | 35.8 |

The powders were processed by mixing in the following proportions and the mixtures were given the codes as shown in Table 3 below:

TABLE 3

| Code | A % | B % |
|---|---|---|
| A | 100 | — |
| A25B | 75 | 25 |
| A50B | 50 | 50 |
| A75B | 25 | 75 |
| B | — | 100 |

The powder mixtures also included 1 wt % of a lubricant known as "ACRAWAX" (trade mark). The mixed powders were then pressed into blanks at a pressure of 620 MPa using a die set of dimensions: OD 38.7 mm, ID 28.7 mm and a predetermined weight of powder of 11 g to form green blanks. The green blanks were subsequently sintered in a nitrogen-based atmosphere at temperatures ranging from 520° C. to 610° C. for about 10 minutes in a horizontal chamber furnace having a heating and a cooling zone.

The samples were analysed and tested for their microstructure and properties including green and sintered density, size change, hardness and radial crushing strength.

Green densities are shown in Table 4 below:

TABLE 4

| Alloy | Green Density | |
|---|---|---|
| | Actual (g/cm3) | % Theor. |
| A | 2.45 | 91 |
| A25B | 2.42 | 90 |
| A50B | 2.38 | 88 |
| A75B | 2.35 | 87 |
| B | 2.30 | 85 |

A and the alloys having higher proportions of A tend to have higher green densities due to the lower levels of alloying additions in this powder conferring greater compressibility. 100% A has the highest density whilst 100% B has the lowest at the given pressing pressure.

Figure 1:
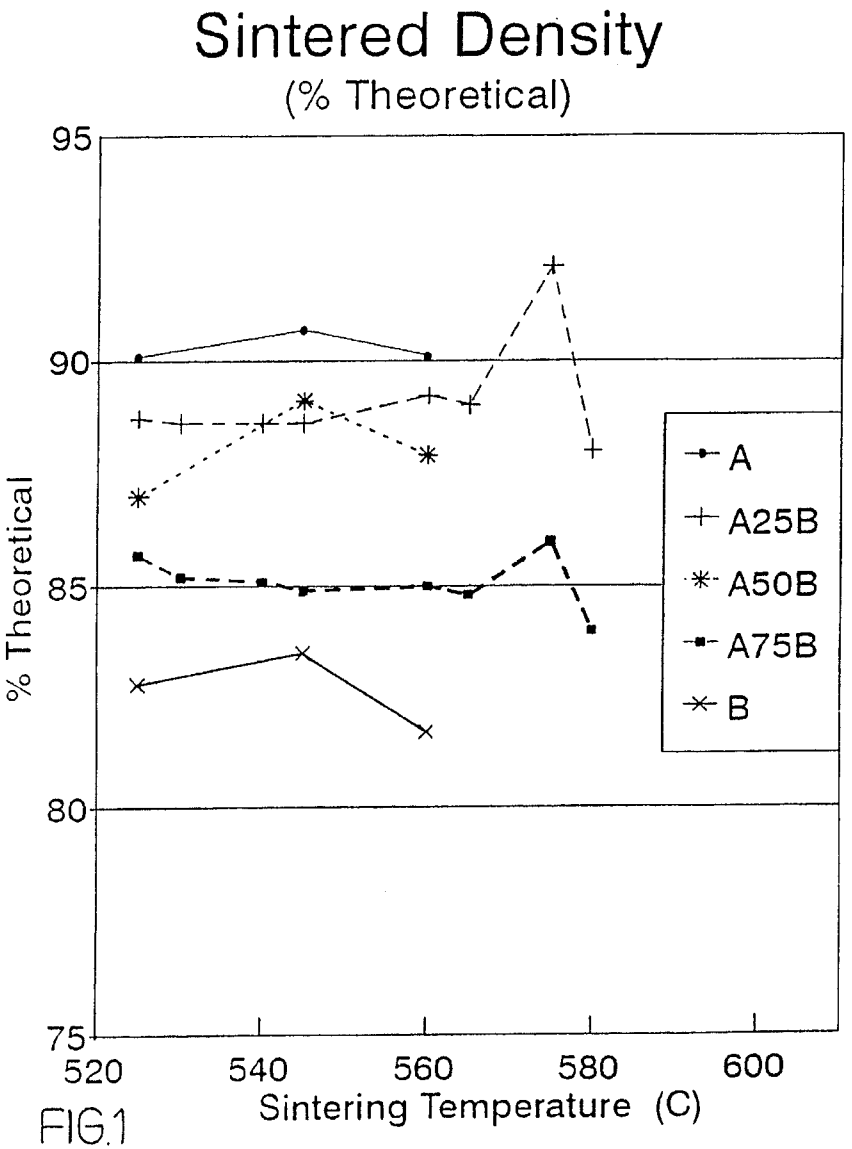
FIG. 1 snows a graph of % theoretical density vs sintering temperature for aluminium alloys according to the present invention pressed at 620 MPa.

FIG. 1 shows a graph of the % theoretical sintered density of the alloys as a function of sintering temperature.

Figure 2:
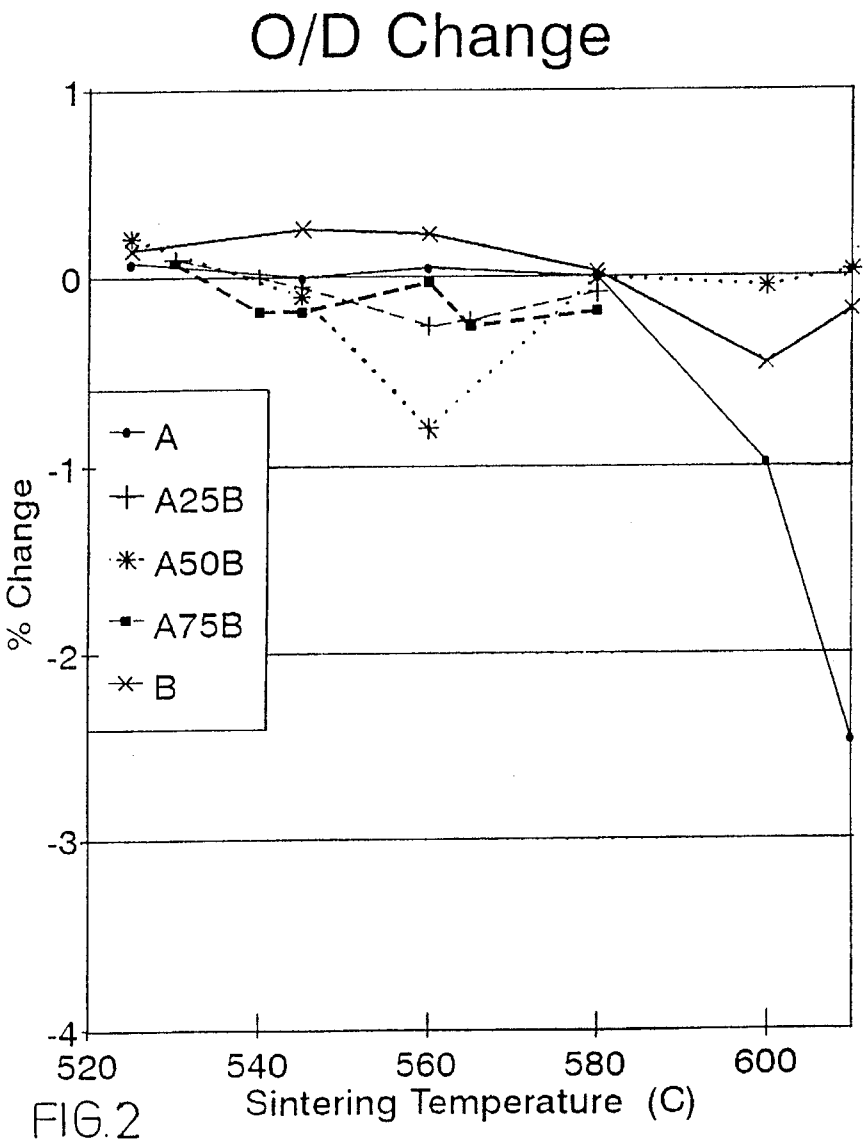
FIG. 2 shows a graph of % size change of the OD of a ring vs sintering temterature.
Figure 3:
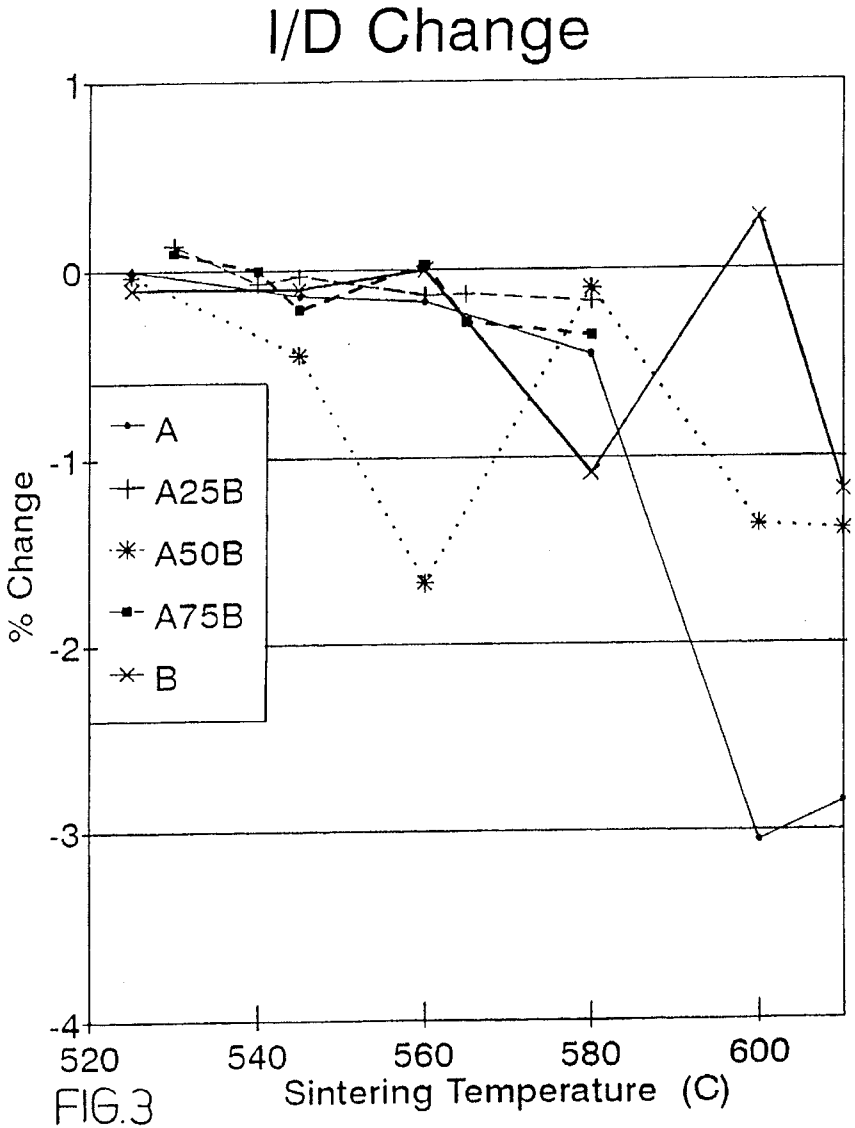
FIG. 3 shows a graph of % size change of the ID of a ring vs sintering temperature.

FIGS. 2 and 3 show graphs of the change in OD and ID, of the test pieces, respectively. Generally, the size changes on sintering are small, varying in the range from about +0.2% to about −1%. However, it is clear that some reaction between the constituent alloys is occurring between 540° C. and 580° C. as witnessed by the significant shrinkage which occurs up to about 560° C. and which is then followed by an expansion up to about 580° C.

Figure 6:
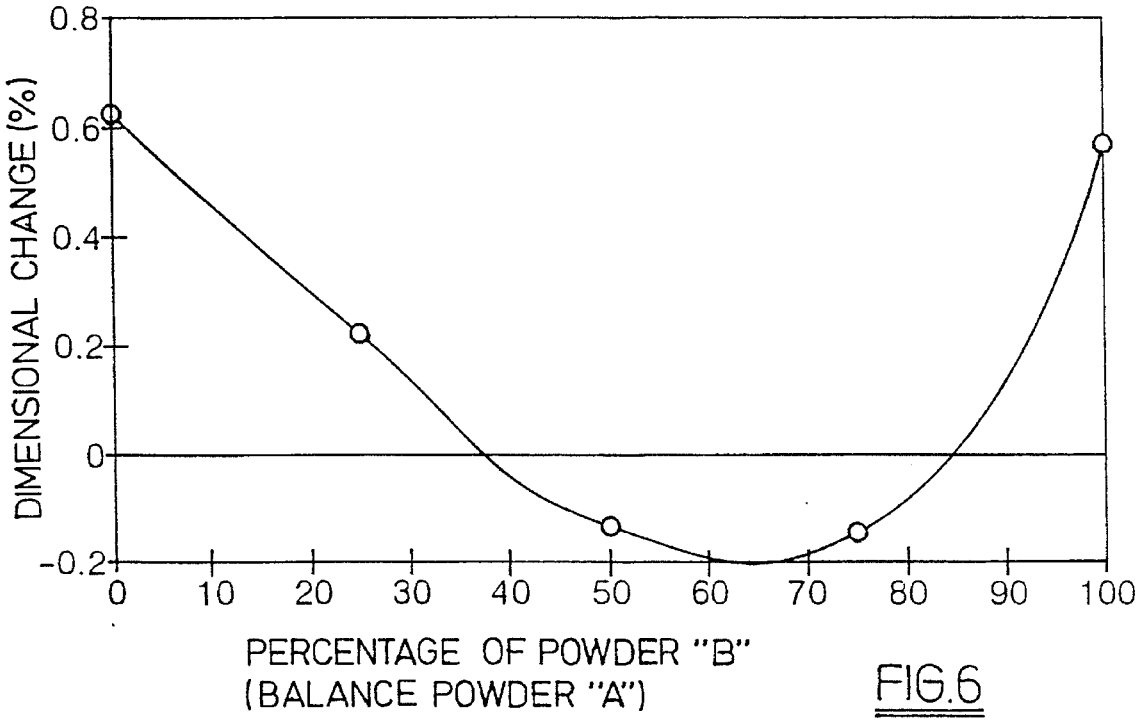
FIG. 6 shows a graph of dimensional change on sintering at a constant temperature vs powder mixture constiruents.

FIG. 6 shows a graph of dimensional change against the powder mixture constitution at a constant sintering temperature of 560° C. It may be seen that there is a range of powder mixtures comprising from about 40 to 80wt % of powder "B" where there is a relative stable regime of shrinkage on sintering, suggesting the ability to exercise close control in a production environment.

Figure 4:
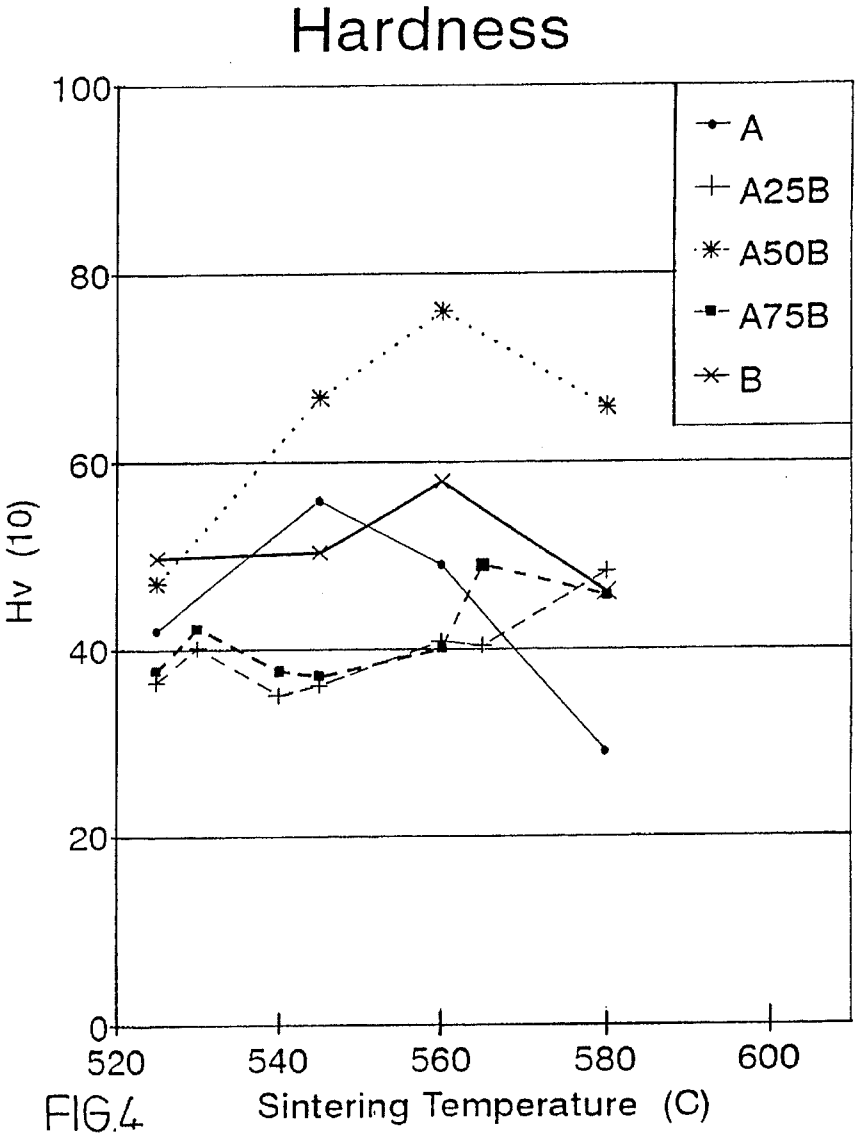
FIG. 4 shows a graph of hardness vs sintering temperature.
Figure 7:
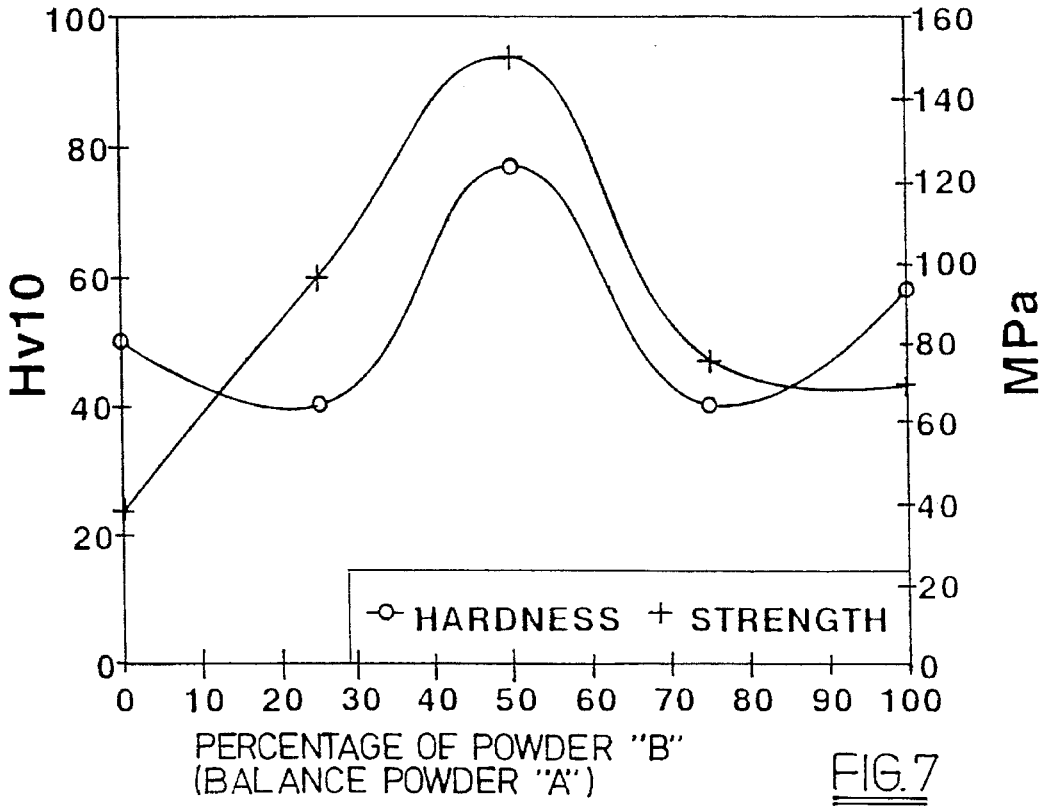
FIG. 7 which shows a graph of hardness and radial crushing strength vs powder mixture constituents.

FIG. 4 shows a graph of hardness of the sintered alloys as a function of sintering temperature. That a reaction during sintering is occurring is again indicated by the results shown in FIG. 4 whilst the hardnesses of the individual constituent powders tend to be greater than the hardnesses of the intermediate mixtures, at least up to a sintering temperature of about 560° C., the 50/50 mixture has a consistently higher hardness over most of the complete range of sintering temperatures. The effect appears to reach its peak when there are approximately equal quantities of the two powders present. FIG. 7 also shows the variation of hardness at a constant sintering temperature of 560° C. against powder mixture constitution. It may be seen very clearly that hardness is at a maximum where there are approximately equal proportions of each constituent powder. The maximum hardness of the mixture is much increased over those of either of the pure constituent powders, demonstrating the synergistic effect produced with the method and material of the present invention.

Figure 5:
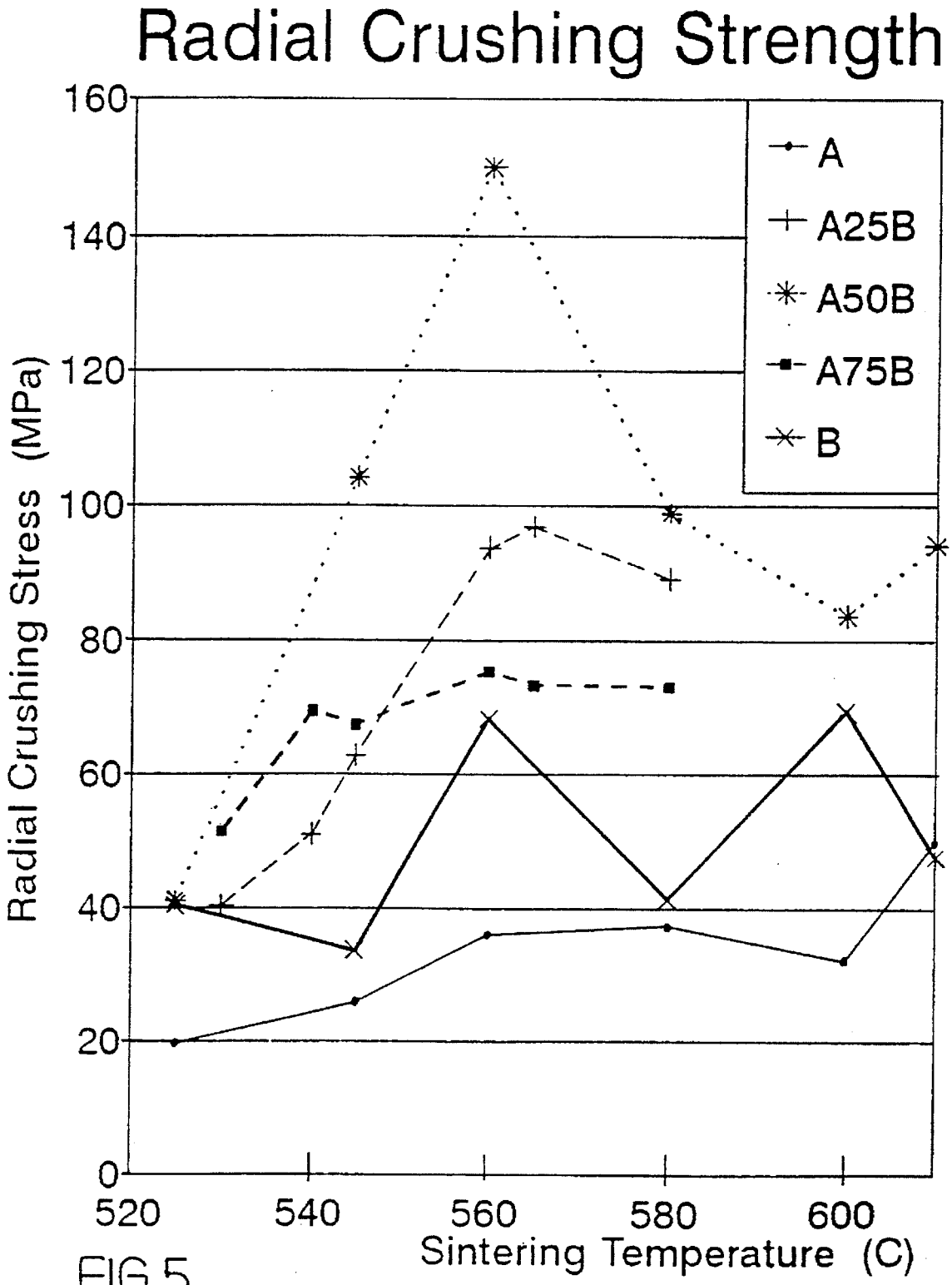
FIG. 5 shows a graph of radial crushing strength vs sintering temperature.

FIG. 5 shows a graph of radial crushing strength for the sintered alloys as a function of sintering temperature. The radial crushing strength test was carried out by crushing a ring of dimensions OD 38.7 mm: ID 28.7 mm; axial length 10 mm with the axis of the ring transverse to the pressing direction. The radial crushing strength data is re-presented in FIG. 7 where the radial crushing strength of the material having approximately equal proportions of powders "A" and "B" may be clearly seen to be at a maximum. Again, the synergistic effect is clearly demonstrated.

The synergistic effect of mixing and sintering the two constituent powders is more clearly shown in the results in FIG. 5 than in the hardness results of FIG. 4. In this case, all the intermediate mixture compositions have higher radial crushing strengths than the individual constituent powders at all sintering temperatures. Again, the effect is most emphatically demonstrated when there are approximately equal amounts of the two powders, and when the sintering temperature lies in the range from about 540° C. to about 580° C.

The microstructures of the various alloys tended to show a very fine structure at the lower sintering temperatures, reflecting the microstructures of the original atomised powder particles. It is believed that the increase in hardness and radial crushing strength up to a sintering temperature of about 560° C. is due to the beneficial effects of interparticle bonding during compaction leading to enhanced diffusion during sintering, whilst the decrease in these properties at sintering temperatures above about 560° C. may be due to coarsening and incipient melting.

We claim:

1. An aluminium alloy made by a powder metallurgy route, the aluminium alloy having a structure comprising at least two interpenetrating reticular structures derived from the original powder particles, said at least two reticular structures including a first structure derived from a first alloy powder comprising a near-eutectic aluminium-silicon based material and a second structure derived from a second alloy powder comprising a hypereutectic aluminium-silicon based material, said aluminium alloy being characterised in that the relative proportions of said first and said second structures lie in the range from about 25:75% and 75:25%, respectively.

2. An aluminium alloy according to claim 1 characterised in that the two reticular structures have an intermediate zone formed by interfacial diffusion between the at least two structures.

3. An aluminium alloy according to claim 1 characterised in that at least one of the constituent alloy materials has an age hardening reaction to suitable heat treatment.

4. An aluminium alloy according to claim 1 characterised in that the relative proportion of said first and said second structures are approximately equal.

5. An aluminium alloy according to claim 1 characterised in that said first structure has a nominal composition in wt % of 11 Si/1 Cu/balance Al.

6. An aluminium allow according claim 1 characterised in that said second structure has a nominal composition in wt % of 18 Si/4.5 Cu/0.5 Mg /1.1 max Fe/balance Al.

7. A method for the production of an aluminium alloy by a powder metallurgy route, the method comprising the steps of producing at least a first powder of a near-eutectic aluminium-silicon based first alloy; producing at least a second powder of a hypereutectic aluminium-silicon based second alloy; mixing desired proportions of the at least first and second powders together; compacting the powder mixture and sintering the compacted powder, the method being characterised in that the desired relative proportions of said first alloy and said second alloy powders lie in the range from 25:75% and 75:25%, respectively.

8. A method according to claim 7 characterised in that at least one of the constituent first and second alloy powders contains further alloying additions.

9. A method according to claim 7 characterised in that a transient liquid phase is formed at the interparticulate interfaces between each constituent alloy.

10. A method according to claim 7 characterised in that the powder mixture further includes an addition of a third powder to act as a sintering aid.

11. A method according to claim 7 characterised in that the near-eutectic aluminium silicon based first alloy has a nominal composition comprising in wt % 11 si/1 Cu/Bal Al.

12. A method according to claim 7 characterised in that the hypereutectic aluminium silicon based second alloy has a nominal composition comprising in wt % 18 Si/4.5 Cu/0.5 Mg/1.1 max Fe/Bal Al.

13. A method according to claim 7 characterised in that each of the near-eutectic first alloy and hypereutectic second alloy are present in approximately equal portions.

14. A method according to claim 7 characterised in that the sintering temperature lies in the range from about 520° C. to about 600° C.

15. A method according to claim 7 characterised in that the sintering time lies in the range from about 5 minutes to about 60 minutes.

* * * * *

UNITED STATES PATENT AND TRADEMARK OFFICE

CERTIFICATE OF CORRECTION

PATENT NO. : 5,613,184

DATED : March 18, 1997

INVENTOR(S) : Purnell et al

It is certified that error appears in the above-indentified patent and that said Letters Patent is hereby corrected as shown below:

Column 1, line 11, change "rime" to --time--

Column 1, line 24, start a new paragraph with "Generally,"

Column 1, line 48 start a new paragraph with "According"

Column 2, line 27 change "proportion" to --proportions--

Column 3, line 15, change "constiruents" to --constituents--

Column 4, line 50, insert -- . -- after "FIG. 4"; and change "whilst" to --Whilst--

Column 6, line 7, after "according" insert --to--

Signed and Sealed this

Twenty-sixth Day of August, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,613,184
DATED : March 18, 1997
INVENTOR(S) : Purnell, et. al.

It is certified that error appears in the above-identified patent and that said Letters Patent is hereby corrected as shown below:

Column 1, line 50, start a new paragraph with "According"
Column 2, line 28, change "proportion" to --proportions--
Column 6, line 32, change "11si/1" to --11 Si/1--
Column 6, line 39, change "portions" to --proportions Signed and Sealed this Twentieth Day of October, 1998

Bruce Lehman

*Attest:*

BRUCE LEHMAN

*Attesting Officer*

*Commissioner of Patents and Trademarks*